United States Patent [19]

Bayat

[11] Patent Number: 4,583,664

[45] Date of Patent: Apr. 22, 1986

[54] LIQUID DISPENSING SYSTEM

[76] Inventor: John J. Bayat, 3705 Boulder Ct., Reno, Nev. 89509

[21] Appl. No.: 525,555

[22] Filed: Aug. 22, 1983

Related U.S. Application Data

[63] Continuation-in-part of Ser. No. 234,961, Feb. 17, 1981, abandoned.

[51] Int. Cl.[4] ..... B67D 1/04

[52] U.S. Cl. ..... 222/61; 222/69

[58] Field of Search ..... 223/158, 640, 641, 51, 223/181, 185, 129.1, 129.3, 129.4; 248/309.2, 311.3; 222/504, 61, 69

[56] References Cited

U.S. PATENT DOCUMENTS

| | | | |
|---|---|---|---|
| 2,848,140 | 8/1958 | Gabrielsen | 222/51 |
| 3,057,518 | 10/1962 | Japp | 222/69 |
| 3,193,143 | 7/1965 | Maieli | 222/129.4 |
| 3,435,989 | 4/1969 | Lorenzen | 222/51 X |
| 3,802,606 | 4/1974 | Gust | 222/504 |
| 3,991,911 | 11/1976 | Shannon et al. | 222/504 X |
| 4,288,007 | 9/1981 | Rogers et al. | 248/311.3 |

*Primary Examiner*—Stanley H. Tollberg
*Attorney, Agent, or Firm*—Hohbach, Test, Albritton & Herbert Flehr

[57] ABSTRACT

Liquid dispensing system utilizing individual modular cartridges removably mounted at the dispensing stations of a control console in plug-in fashion. Each cartridge carries one bottle, and has an outlet and valve structure for controlling the discharge of liquid from the bottle to the outlet. In some embodiments, the cartridge includes a measuring cup which determines the amount of liquid dispensed, and in some of these embodiments the liquid is pressurized for delivery to and/or from the measuring cup.

7 Claims, 6 Drawing Figures

LIQUID DISPENSING SYSTEM

This is a continuation-in-part of Ser. No. 234,961, filed Feb. 17, 1981, now abandoned.

This invention pertains generally to liquid dispensing systems and more particularly to a system for dispensing measured amounts of alcoholic beverages or other liquids from bottles.

It is in general an object of the invention to provide a new and improved system for dispensing a controlled amount of liquid from a bottle.

Another object of the invention is to provide a system of the above character in which the bottles are carried by modular cartridges which are removably mounted in a control console in plug-in fashion.

These and other objects are achieved in accordance with the invention by providing a control console having a plurality of dispensing stations, and a bottle carrying modular cartridge removably mounted on the console in plug-in fashion at one of the stations. The cartridge has a liquid outlet and a valve for controlling the passage of liquid from the bottle to the outlet. Means carried by the console is connected to the valve for controlling the discharge of liquid from the bottle through the outlet.

Figure 1:
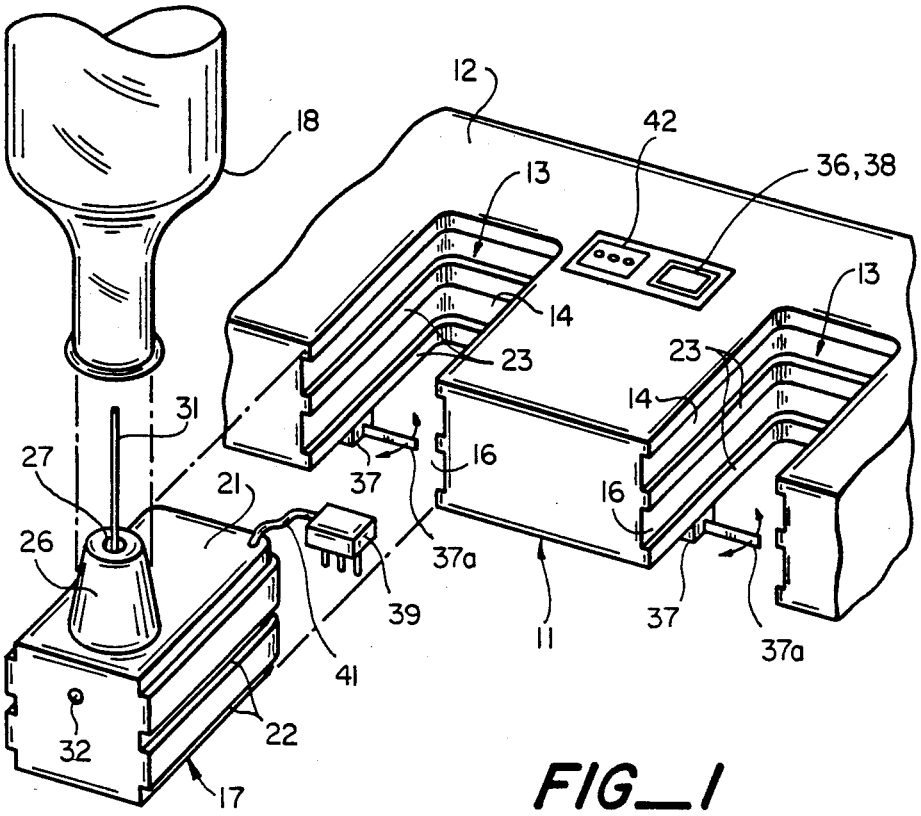
FIG. 1 is a fragmentary isometric view, partly exploded, of one embodiment of a liquid dispensing system according to the invention.
Figure 2:
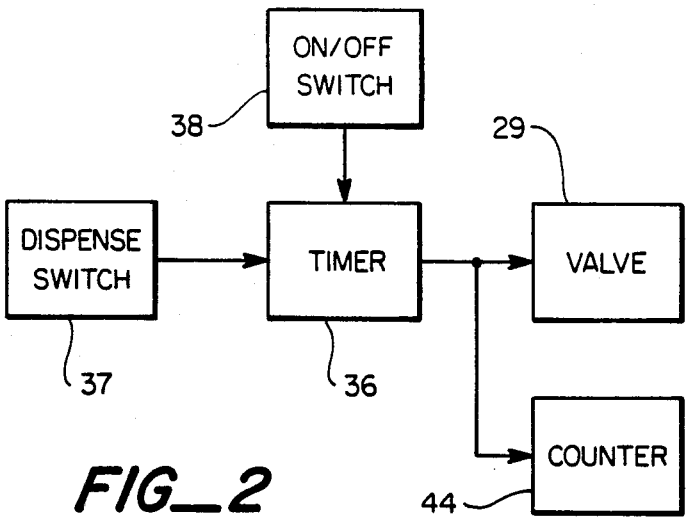
FIG. 2 is a block diagram of the control circuitry of the embodiment of FIG. 1.

As illustrated in FIG. 1, the liquid dispensing system comprises a base cabinet or control console 11 having a generally planar upper surface 12 and a plurality of dispensing stations 13. Each of the dispensing stations comprises a bay 14 having an open outer side 16 for receiving in plug-in fashion a modular cartridge 17 carrying a bottle 18 containing a liquid to be dispensed.

Each of the cartridges 17 comprises a generally rectangular body 21 having horizontally extending grooves 22 on three sides thereof for engagement with mating flanges or guide rails 23 which extend horizontally along the three corresponding sides of each bay in the control console. The cartridges are inserted into the bays through the open sides thereof, with the guide rails and grooves in mating engagement to hold the cartridges in a predetermined position in the bays, e.g. with the upper surfaces of the cartridges flush with the upper surface of the console. In the embodiment of FIG. 1, each of the cartridges includes a conically tapered plug 26 which is affixed to and projects upwardly from cartridge body 21. The bottles are carried by the cartridges in an inverted position, with the tapered plugs extending into the neck portions of the bottles to form a liquid-tight seal. An inlet passageway 27 for the liquid in the bottle is formed in the plug, and an outlet spout 28 projects from the lower side of the cartridge body. Communication between the inlet passageway and the outlet spout is controlled by a normally closed solenoid operated valve 29 inside the body of the cartridge. A vent tube 31 extends upwardly into the bottle from plug 26 and communicates with a vent opening 32 in the cartridge body to provide venting for each bottle.

The operation of valve 29 is controlled by a timer 36 mounted in control console 11. In one presently preferred embodiment, this timer comprises a D.C. operated integrated circuit timing device which delivers a pulse of predetermined width when triggered. This pulse turns on a transistor or other suitable switching device to supply operating power to actuate the dispensing valve for the duration of the pulse. Trigger signals are applied to the timer by a manually operated switch 37, which has an actuating arm **37*a* positioned for engagement by a glass moving into a position beneath outlet spout 28. An on/off switch 38 is mounted on the console in proximity to each dispensing station, and in one presently preferred embodiment, this switch and timer 36 are mounted on the console in the form of a replaceable module. Electrical connections between the valves and timer are made by means of a plug 39 and cable 41 connected to the cartridge and a socket 42 mounted on the console. The output of timer 36 is also connected to the input of a counter 44** to register the amount of liquid dispensed from the bottle.

Operation and use of the liquid dispensing system is as follows. It is assumed that a plurality of bottles 18 are mounted on cartridges 17 and that the cartridges are plugged into the control console in the manner heretofore described, with plugs 39 inserted into sockets 42. To dispense a measured amount of liquid from a given bottle, the operator simply moves a glass into position beneath the outlet spout 28, thereby actuating switch 37 so that the liquid is discharged from the bottle into the glass for the period of time set by timer 36. The amount of liquid dispensed from the bottle is registered by counter 44.

Figure 3:
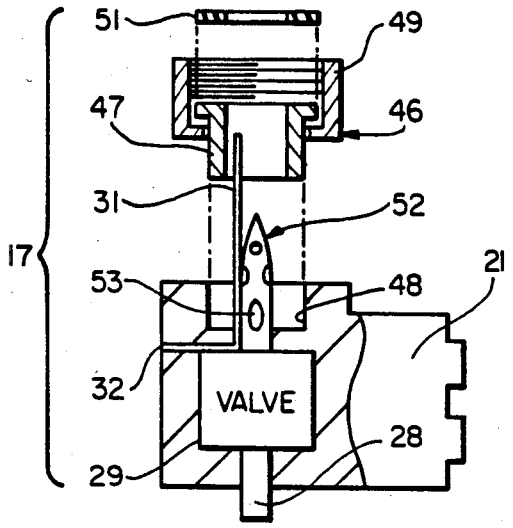
FIG. 3 is a fragmentary cross-sectional view, partly exploded, of a second embodiment of a bottle carrying cartridge for use in the embodiment of FIG. 1.

The cartridge illustrated in FIG. 3 is generally similar to cartridge 17 except for the manner in which the bottle is mounted. Instead of a tapered plug, this cartridge has a threaded connector 46 for engagement with the external threads on the neck portion of a bottle. The connector comprises an inner stem 47 mounted in a bore 48 in the upper portion of the cartridge body, an internally threaded sleeve 49 rotatively mounted on the inner stem, and an annular washer or gasket 51. A tube 52 having inlet openings 53 for the liquid extends into the neck portion of the bottle, and communication between the inlet openings and outlet spout 28 is controlled by solenoid operated valve 29.

Operation and use of the cartridge of FIG. 3 is similar to that described above in connection with the embodiment of FIG. 1.

Figure 4:
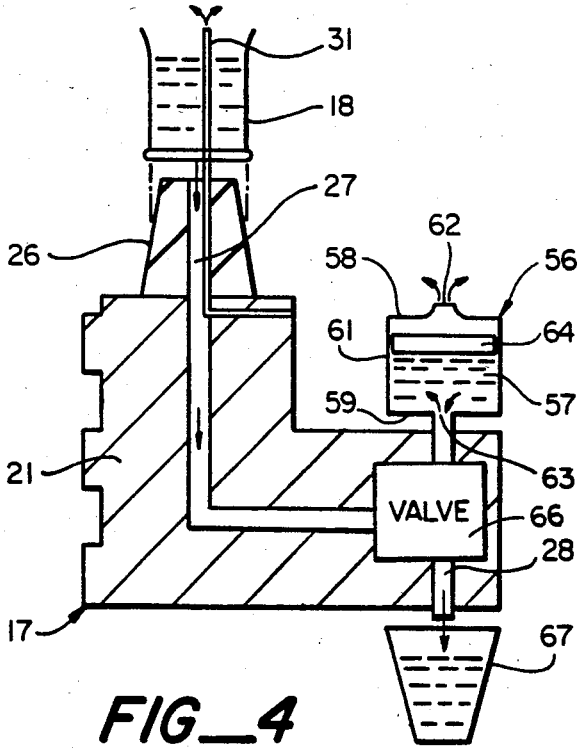
FIG. 4 is a cross-sectional view, partly exploded, of another embodiment of a cartridge module for use in a liquid dispensing system according to the invention.

In the embodiment of FIG. 4, a bottle 18 is once again mounted in an inverted position on cartridge 17, with tapered plug 26 forming a seal with the neck portion of the bottle and vent tube 31 extending upwardly into the bottle through inlet passageway 27. A measuring cup 56 of predetermined volume is mounted on the cartridge body in a lower position than the bottle so that liquid can flow by gravity from the bottle to the cup. Outlet spout 28 is positioned below cup 56, and liquid can also flow by gravity from the cup to the spout.

Measuring cup 56 is removably mounted on the modular cartridge and is interchangeable with other measuring cups of different volumes. The cup has a chamber 57 defined by a top wall 58, a bottom wall 59 and a side wall 61. A vent opening 62 is formed in the top wall, a liquid opening 63 is formed in the bottom wall, and a float 64 floats on the liquid within the chamber. The float functions as a valve which closes vent opening 62 when the cup is filled with a predetermined amount of liquid.

Communication between inlet passageway 27, cup chamber 57, and outlet spout 28 is controlled by a solenoid operated valve 66. This valve is a three-way valve which provides communication between the bottle and the cup when de-energized and between the cup and the outlet spout when energized. Energization of this valve is controlled by switch 37 and actuating arm 37*a*. Since the amount of liquid dispensed is determined by the volume of the measuring cup, no timer is required in this embodiment, and counter 44 responds directly to switch 37 to monitor the number of drinks dispensed.

Operation and use of the embodiment of FIG. 4 is as follows. It is assumed that a plurality of bottles 18 and measuring cups 56 are mounted on cartridges 17 and that these modular cartridges are plugged into the control console in the manner heretofore described. When solenoids 66 are de-energized, liquid flows by gravity from the bottles to the measuring cups until floats 64 close vent openings 62. The amount of liquid thus measured remains in each of the cups until one of the solenoids is energized by placing a glass 67 beneath outlet spout 28, thereby actuating switch 37. The measured quantity of liquid then flows from the cup to the glass. When the glass is removed, the solenoid is de-energized, and the cup is once again filled with the measured quantity of liquid from the bottle.

Figure 5:
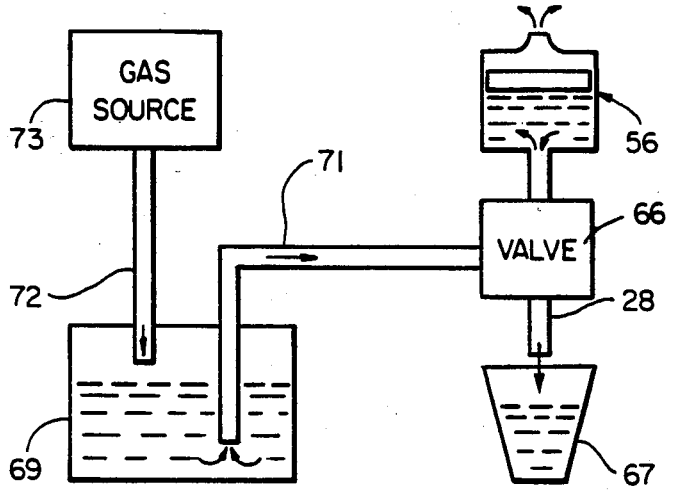
FIGS. 5 and 6 are schematic illustrations of additional embodiments of a liquid dispensing system according to the invention.

The embodiment of FIG. 5 is generally similar to the embodiment of FIG. 4, and corresponding elements are once again designated by like reference numerals. In the embodiment of FIG. 5, however, the source of liquid comprises a closed reservoir 69 with an outlet line 71 connected to valve 66. An inlet line 72 is connected to a source 73 of pressurized gas such as air. Reservoir 69 can be positioned at any desired level relative to measuring cup 56 since this embodiment is not dependent upon the force of gravity to deliver the liquid from the reservoir to the cup.

Operation and use of the embodiment of FIG. 5 is generally similar to that described above in connection with the embodiment of FIG. 4, except that the liquid is delivered from reservoir 69 to measuring cup 56 by the pressure developed in the reservoir by the pressurized gas, rather than flowing by the force of gravity.

Figure 6:
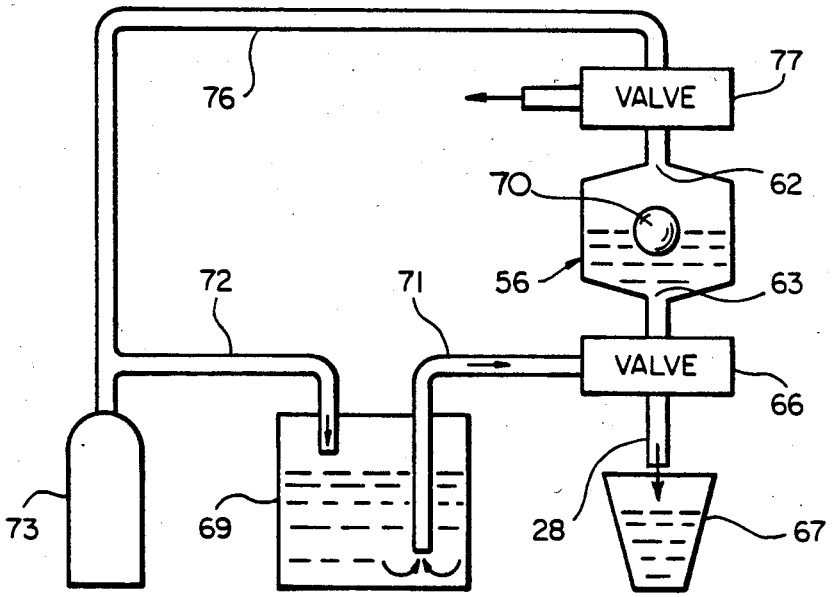

In the embodiment of FIG. 6, pressurized gas is utilized for delivering the liquid both from reservoir 69 to measuring cup 56 and from the measuring cup to glass 67. This embodiment is generally similar to the embodiment of FIG. 5, with an additional air line 76 and control valve 77 being connected between gas source 73 and the vent opening 62 of the measuring cup. Valve 77 is a three-way solenoid operated valve, and when this solenoid is de-energized, vent opening 62 is vented to the atmosphere. When the solenoid is energized, air line 76 communicates with the vent opening. Energization of this valve is controlled by switch 37 and actuating arm 37*a*.

In this embodiment, the top and bottom walls of measuring cup 56 are conically tapered, and the float comprises a spherical ball 70 which can seat in either opening 62 or opening 63 to close the same.

Operation and use of the embodiment of FIG. 6 is as follows. With valves 66 and 77 both de-energized, liquid is delivered under pressure from reservoir 69 to the chamber of measuring cup 56 through valve 66, and air is vented from the chamber through valve 77 until float ball 78 closes the vent opening. The amount of liquid thus measured remains in the cup until valves 66 and 77 are actuated, at which time pressurized gas is admitted to the measuring cup through valve 77, thereby discharging the liquid from the cup to glass 67 through valve 66. When the liquid has been discharged, ball 78 closes opening 63, thereby preventing an undesirable discharge of air through the outlet spout. When the solenoids are de-energized, the cup is once again filled with liquid from the reservoir in the manner heretofore described.

It is apparent from the foregoing that a new and improved system for dispensing liquid from bottles has been provided. While only certain presently preferred embodiments have been described in detail, as will be apparent to those familiar with the art, certain changes and modifications can be made without departing from the scope of the invention as defined by the following claims.

I claim:

1. In a system for dispensing liquid from bottles: a console having a generally planar upper surface and a plurality of dispensing stations each comprising a generally rectangular bay which opens through the upper surface of the console and is open on one side thereof; individual generally rectangular modular cartridges having generally planar upper surfaces removably mounted in the bays through the open sides thereof with horizontally extending mating guide rails carried by the console and cartridges guiding the cartridges into the bays and holding the cartridges in the bays with the upper surfaces of the cartridges flush with the upper surface of the console; each of said cartridges comprising a body, means for holding a bottle in an inverted position on the body, a fluid outlet, and valve means for controlling communication between the bottle and the outlet; actuating arms mounted on the console and extending beneath the bays for engagement by glasses moved into position to receive liquid from the outlets in the respective cartridges; and means responsive to the actuating arms connected to the valve means for controlling the amount of liquid dispensed from each of the bottles.

2. The system of claim 1, including means carried by the cartridges for admitting air into the bottles to vent the same.

3. The system of claim 1 further including means connected to the means for controlling the amount of liquid dispensed for registering the amount of liquid dispensed from each of the bottles.

4. In a liquid dispensing system: a console having a plurality of dispensing stations, a source of liquid to be dispensed at one of the dispensing stations, a measuring cup of predetermined volume for receiving liquid from the source, said measuring cup having a closed chamber with a vent opening in the upper portion thereof and a liquid opening in the lower portion thereof, level responsive valves means comprising a float member which can close either the vent opening or the liquid opening depending upon the amount of liquid in the chamber, a source of pressurized gas connected to the source of liquid for delivering liquid from the liquid source to the measuring cup, and means interconnecting the gas source and the cup for introducing pressurized gas into the cup to dispense the liquid therefrom.

5. In a liquid dispensing system: a console having a plurality of dispensing stations, a source of liquid to be dispensed at one of the dispensing stations, a measuring cup of predetermined volume for receiving liquid from the source, means for introducing a pressurized gas into the source of liquid to move the liquid from the source to the cup, a vent opening in the upper portion of the measuring cup, level responsive valve means including a float member in the measuring cup for closing the vent opening to terminate the flow of liquid to the cup from the source when the cup contains a measured quantity of liquid, and means for introducing the pressurized gas into the measuring cup to discharge the liquid therefrom.

6. The system of claim 5 wherein the measuring cup is interchangeable with other cups of different volumes.

7. In a liquid dispensing system: a console having a plurality of dispensing stations, a source of liquid to be dispensed at one of the dispensing stations, a measuring cup of predetermined volume for receiving liquid from the source, an opening in the upper portion of the measuring cup, a source of pressurized gas connected to the source of liquid for delivering liquid from the liquid source to the measuring cup, first valve means for controlling the flow of liquid from the liquid source to the cup, said first valve means including a float member in the measuring cup for closing the opening to terminate the flow of liquid to the cup from the source when the cup contains a measured quantity of liquid, and second valve means interconnecting the gas source and the cup for introducing pressurized gas into the cup to dispense the liquid therefrom.

* * * * *